US007552891B2

(12) United States Patent
Huang

(10) Patent No.: US 7,552,891 B2
(45) Date of Patent: Jun. 30, 2009

(54) STRETCH FILM DISPENSER WITH BRAKE DEVICE

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 54 days.

(21) Appl. No.: 11/854,390

(22) Filed: Sep. 12, 2007

(65) Prior Publication Data

US 2009/0050729 A1 Feb. 26, 2009

(51) Int. Cl.
*B65H 75/18* (2006.01)

(52) U.S. Cl. ..... 242/588.2; 242/422.4; 242/405.3

(58) Field of Classification Search ..... 242/405.3, 242/405.2, 405.1, 588, 588.2, 599.4, 597, 242/597.5, 597.6, 596.7, 422.4
See application file for complete search history.

(56) References Cited

U.S. PATENT DOCUMENTS

| | | | | |
|---|---|---|---|---|
| 5,915,642 | A * | 6/1999 | Davis | 242/422.4 |
| 6,227,480 | B1 | 5/2001 | Huang | |
| 6,651,918 | B2 | 11/2003 | Huang | |
| 6,892,975 | B2 * | 5/2005 | Yu Chen | 242/422.4 |
| 7,210,649 | B2 * | 5/2007 | Yu Chen | 242/588.2 |

* cited by examiner

*Primary Examiner*—William A Rivera
(74) *Attorney, Agent, or Firm*—Browdy and Neimark, P.L.L.C.

(57) ABSTRACT

A stretch film dispenser includes a base, a reel and two brake devices. The reel is connected to the base for rotation. The brake devices are connected to two flexible members on an outer annular wall of the base to be pressed for braking the reel.

6 Claims, 5 Drawing Sheets

STRETCH FILM DISPENSER WITH BRAKE DEVICE

BACKGROUND OF THE INVENTION

1. Field of the Invention

The present invention relates generally to a stretch film dispenser, and more particularly to a stretch film dispenser with a brake device to provide the stretch film with a predetermined tension.

2. Description of the Related Art

In package work it is common to dispense stretch film to surround goods. U.S. Pat. No. 6,227,480 is an earlier invention of the present inventor, which provides a stretch film dispenser, known as a "Hand Saver", to protect an operator's hands from injury during package work.

A stretch film dispenser has to provide the stretch film with a tension so that the stretch film may hold the packages firmly. Another invention of the present inventor, U.S. Pat. No. 6,651,918, provides a stretch film dispenser which provides to the reel a resistance (or friction) to give the stretch film a tension. Tension of the stretch film is positive relative to the resistance. However, the resistance can't be so strong that it will affect the package work nor so weak a resistance that the reel can't provide the stretch film with sufficient tension.

SUMMARY OF THE INVENTION

The primary objective of the present invention is to provide a stretch film dispenser that will provide a desired tension to the stretch film.

According to the objective of the present invention, a stretch film dispenser includes a base, a reel and a brake device. The reel is connected to the base for rotation. The brake device is provided on the base to be pressed for braking the reel.

DETAILED DESCRIPTION OF THE INVENTION

Figure 1:
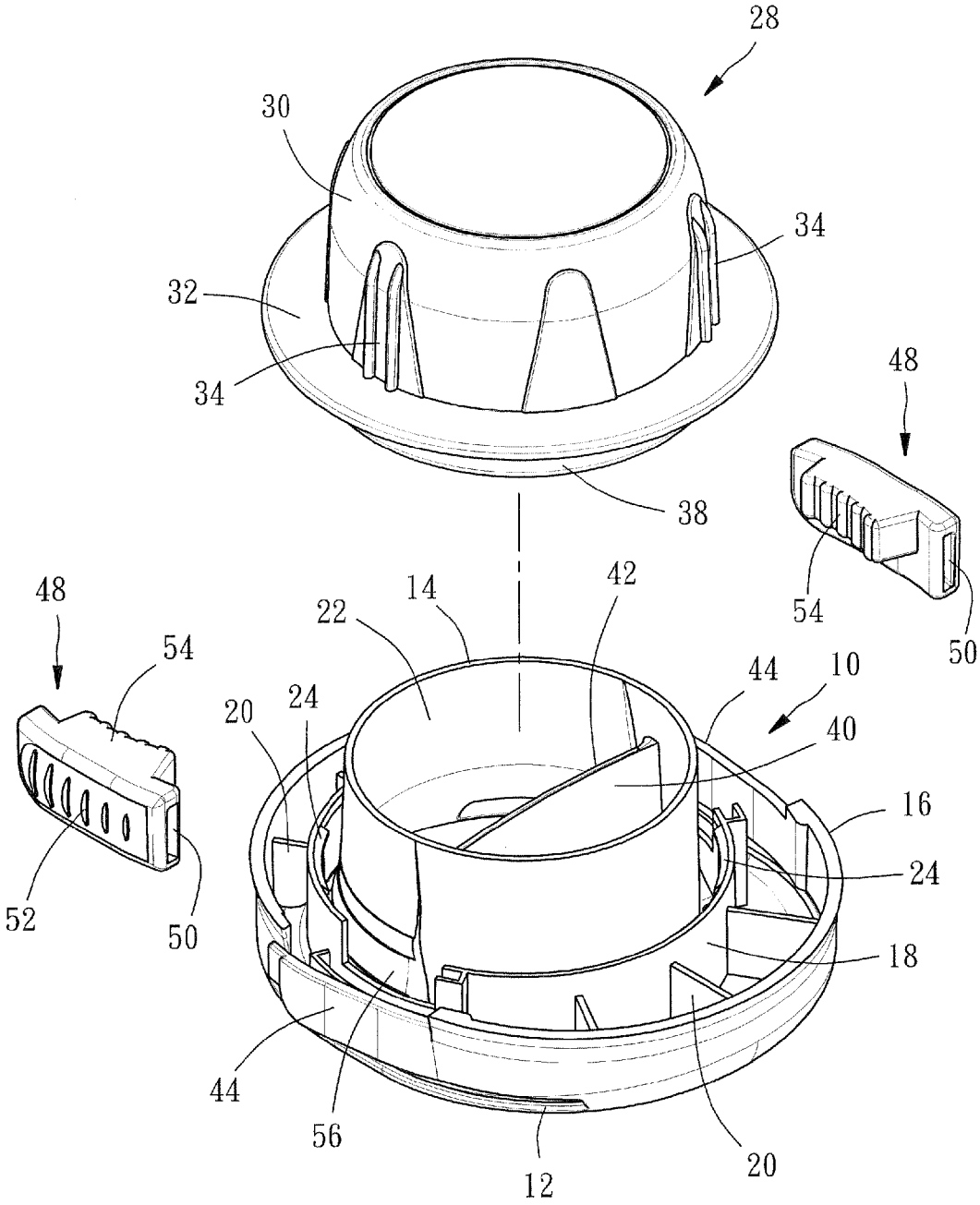
FIG. 1 is an exploded view of a preferred embodiment of the present invention.
Figure 2:
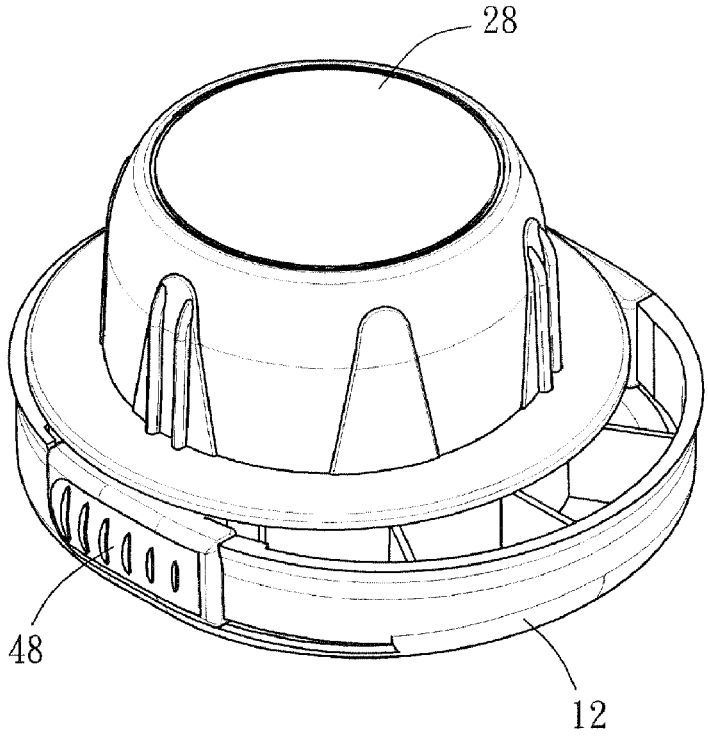
FIG. 2 is a perspective view of the preferred embodiment of the present invention.

As shown in FIG. 1 and FIG. 2, a stretch film dispenser of the preferred embodiment of the present invention includes a base 10, a reel 28, and two brake devices 48.

Figure 3:
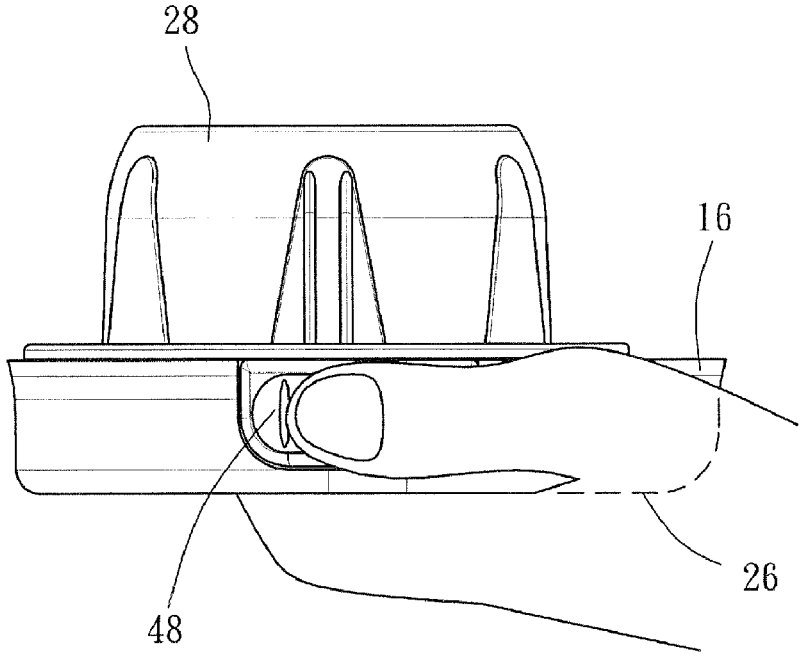
FIG. 3 is a lateral view of the preferred embodiment of the present invention, showing how the operator holds the dispenser.

The base 10 includes a hold base 12 and an axle 14 on a top of the hold base 12 and the axle 14 is not on a center of the hold base 12. The hold base 12 has an outer annular wall 16 and an inner annular wall 18, between which reinforced ribs 20 are 25 provided. The axle 14 is within the inner annular wall 18. The hold base 12 has a hole 22 at a bottom thereof through the axle 14. The inner annular wall 18 has a plurality of hook members 24 on an inner side. The hold base 12 has a hold portion 26 at the bottom thereof from the hole 22 to the outer annular wall 16 to be held by user (referring to FIG. 3).

The reel 28 is a cup-like member, which has a reel portion 30 and a wall portion 32. The reel portion 30 has a plurality of ribs 34 thereon, and the wall portion 32 has an annular hook member 36 on a bottom thereof. The reel 28 is fitted to the axle 14 of the base 10 with the hook members 24 locked with the hook member 36 so that the reel 28 is connected to the base 10 for free rotation. The above elements and structure are the same as U.S. Pat. No. 6,227,480.

The reel 28 is provided with a friction portion 38 at an outer side of the hook member 36, on which protrusion blocks (not shown) are provided.

Figure 4:
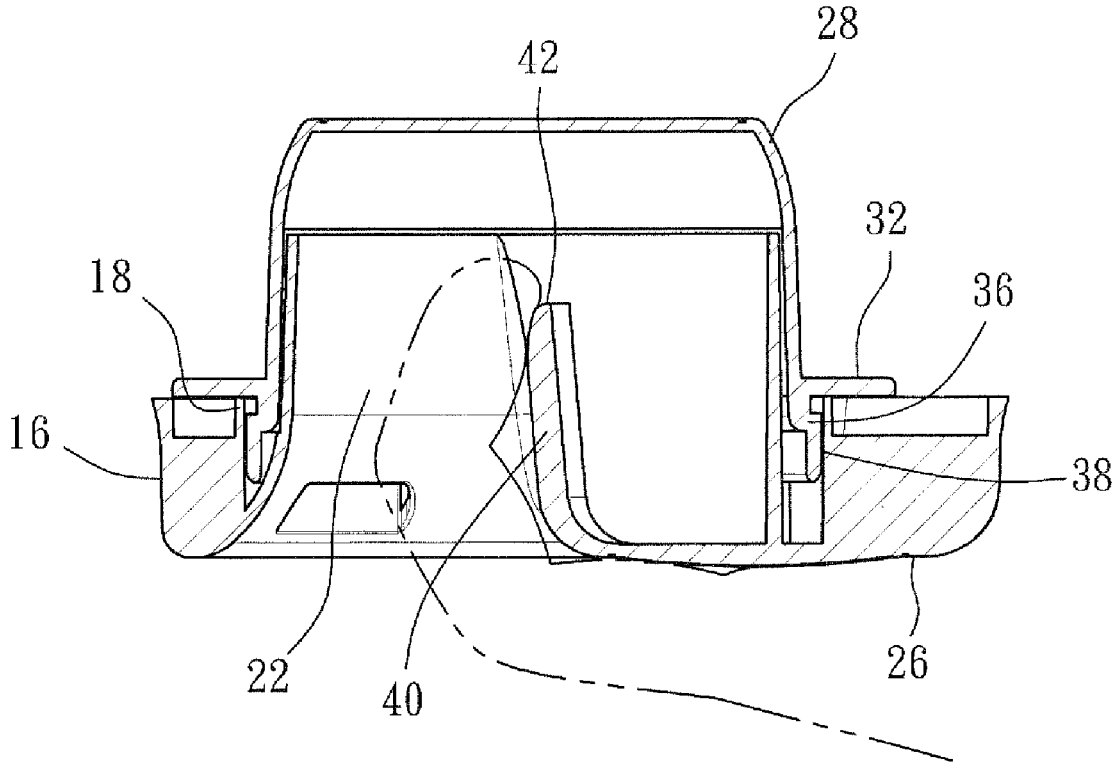
FIG. 4 is a sectional view of FIG. 3.

The hold portion 26 of the base 10 has a plate 40 extending into the hole 22. An inner end of the plate 40 is located at a distance from the reel 28 so that the plate 40 forms a 15 securing portion 42 to be held by user's fingers, referring to FIG. 4, for a firm holding condition.

Figure 5:
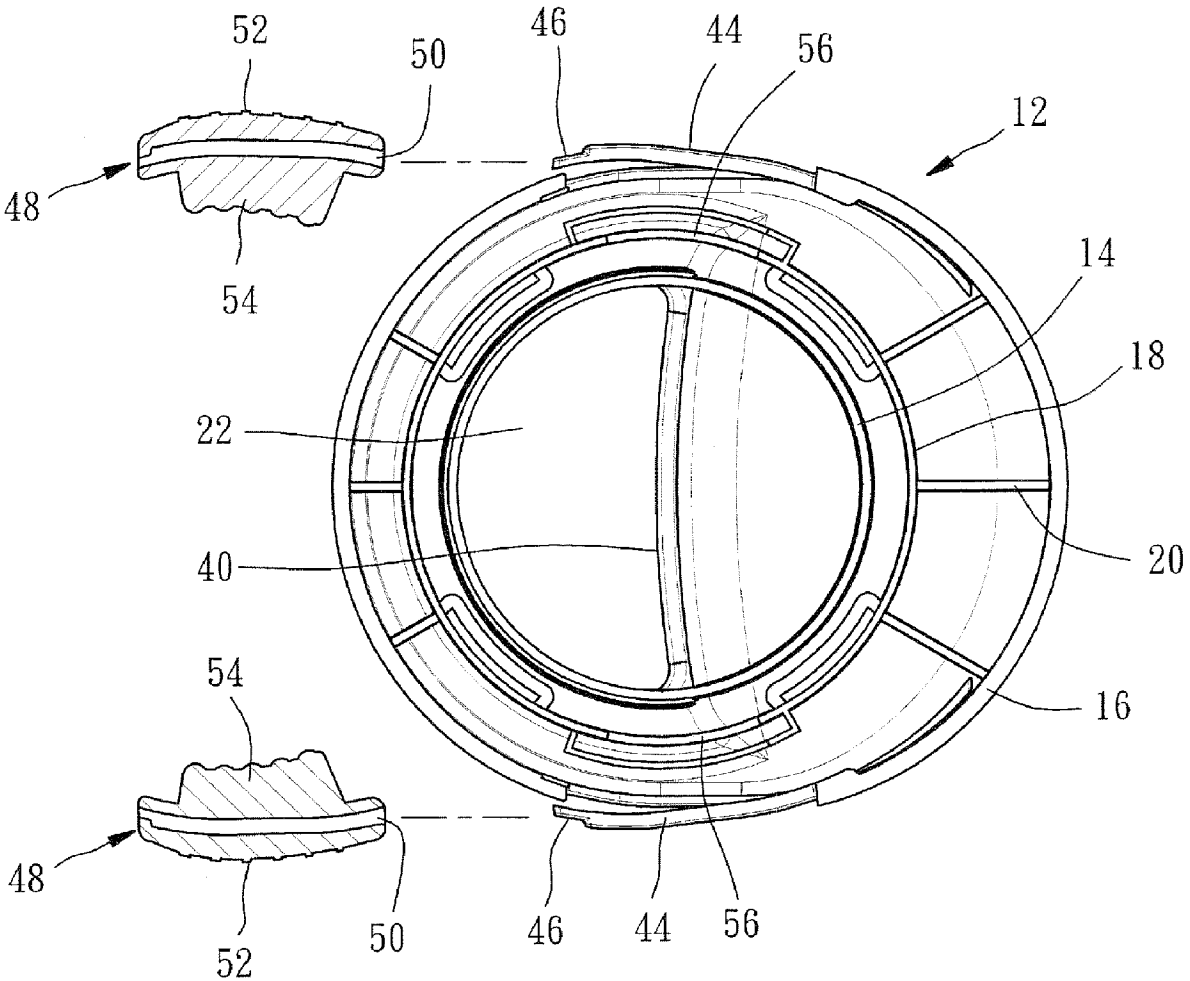
FIG. 5 is a top view of the base of the preferred embodiment of the present invention, showing the initial condition of the flexible members.
Figure 6:
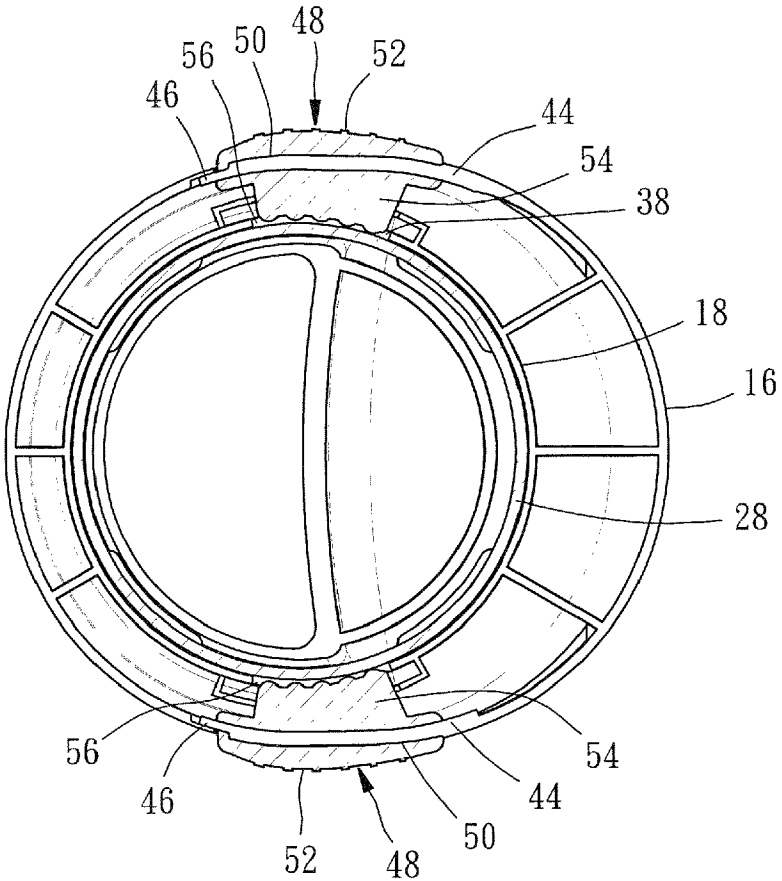
FIG. 6 is a sectional view of the preferred embodiment of the present invention, showing the brake device unpressed.

As shown in FIG. 5, the base 10 is provided with two flexible members 44 on the outer annular wall 16. Each of the flexible members 44 has a free end extending outwardly initially and forms a stop portion 46 at the free end. Each of the brake 20 devices 48, which is made of plastic, rubber or other materials with a predetermined friction coefficient, has a through hole 50, a press portion 52 at an outer side and a friction block 54 at an inner side. The flexible members 44 are inserted into the through holes 50 of the brake devices 48 respectively with the stop portion 46 extending out of the through holes 50. After the brake devices 48 are fitted to the flexible members 44, the free ends of the flexible members 44 are bent inwards to have the stop portions 46 engaged into an inner side of the outer annular wall 16. The inner annular wall 18 has two bores 56, through which the friction blocks 54 of the brake device 48 pass. The reel 28 is fitted to the base 10 after the brake devices 48 are fitted and the flexible members 44 are bent inwards, so that the friction blocks 54 of the brake device 48 face the friction portion 38 of the reel 28 and the wall portion 32 of the reel 28 is above the friction blocks 54 of the brake device 48, as shown in FIG. 6.

Figure 7:
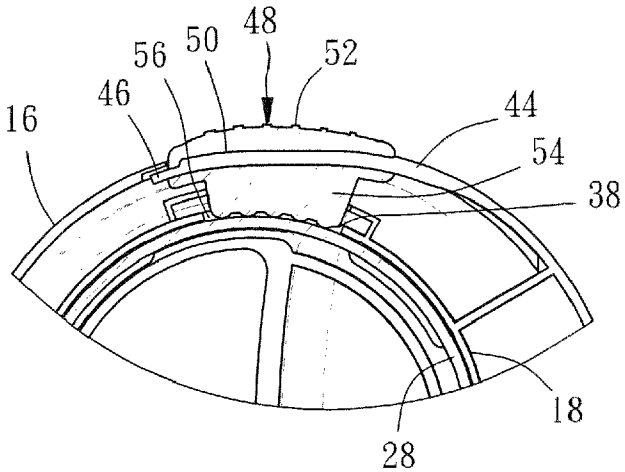
FIG. 7 is a sectional view of the preferred embodiment of the present invention, showing the brake device pressed.

Referring to FIG. 6 again, the stop portions 46 are against the inner side of the outer annular wall 16 in a normal condition because of the elasticity of the flexible members 44 that keeps a distance between the friction blocks 54 and the friction 10 portion 38 of the reel 28. When user presses the press portion 52 of the brake device 48, referring to FIG. 7, the flexible member 44 will be bent inward to have the friction block 54 pressing the friction portion 38 of the reel 28 for giving the reel 28 a brake force. In such condition, the stretch film dispenser of the present invention may provide the stretch film a greater tension. When a user doesn't press the brake device 48, the friction block 54 will leave the friction portion 38 automatically because of the elasticity of the flexible member 44 and return to the normal condition. In such condition, the reel 28 may rotate freely.

When an operator holds the stretch film dispenser of the present invention, his/her thumb may actuate the brake device 48, so that, during the package work, the operator may control the strength of pressing the brake device 48 to provide the stretch film with a desired amount of tension.

The description above is a few preferred embodiments of the present invention and the equivalence of the present invention is still in the scope of the claim of the present invention.

What is claimed is:

1. A stretch film dispenser, comprising:

a base;

a reel, which has a friction portion, connected to the base for rotation;

a brake device, which has a press portion and a friction block, the brake device provided on the base, wherein when the press portion is pressed the friction block comes into engagement against the friction portion of the reel to provide a resistance in rotation of the reel;

wherein the base has an outer annular wall and a flexible member, the brake device being provided on the flexible member, and the flexible member has a free end extending radially outwardly from the annular wall in an initial condition, said flexible member having a stop portion on the free end thereof, the stop portion engaging an inner side of the outer annular wall when the flexible member is bent radially inwardly.

2. The stretch film dispenser as defined in claim 1, wherein the brake device has a through hole, into which the flexible member is inserted with said stop portion extending out of the through hole of the brake device.

3. The stretch film dispenser as defined in claim 1, wherein the base has an inner annular wall, on which a bore is provided, and the friction block of the brake device passes through the bore to face the friction portion of the reel.

4. The stretch film dispenser as defined in claim 1, wherein the base has a hole and a holding portion at a bottom thereof, and the holding portion has a plate extending into the hole to form a securing portion on an inner end of the plate.

5. The stretch film dispenser as defined in claim 1, wherein the reel has a wall portion above the brake device.

6. The stretch film dispenser as defined in claim 1, wherein the base has a hook member and the reel has a hook member for engagement with the hook member of the base, and the friction portion of the reel is provided on the hook member of the reel.

* * * * *